United States Patent [19]

Piacentini

[11] Patent Number: 4,891,965

[45] Date of Patent: Jan. 9, 1990

[54] SYSTEM FOR CONNECTING A BENDING BLADE TO ITS CORRESPONDING SUPPORT IN A SHEET METAL PANEL BENDING MACHINE

[75] Inventor: Dario Piacentini, Lonigo, Italy

[73] Assignee: Salvagnini Transferica S.p.A., Sarego, Italy

[21] Appl. No.: 210,505

[22] Filed: Jun. 23, 1988

[30] Foreign Application Priority Data

Jun. 25, 1987 [IT] Italy ..... 21045 A/87

[51] Int. Cl.[4] ..... B21D 37/14

[52] U.S. Cl. ..... 72/481; 72/462; 72/465; 100/258 R

[58] Field of Search ..... 72/462, 481, 321, 322, 72/465, 389; 100/258 R, 258 A

[56] References Cited

U.S. PATENT DOCUMENTS

| | | | |
|---|---|---|---|
| 3,965,721 | 6/1976 | Roch | 72/389 |
| 4,315,425 | 2/1982 | Zbornik et al. | 72/481 |
| 4,449,389 | 5/1984 | Cros | 72/389 |
| 4,586,361 | 5/1986 | Reinhorn et al. | 72/389 |
| 4,722,214 | 2/1988 | Hayashi et al. | 72/481 |
| 4,790,173 | 12/1988 | Boutcher, Jr. | 72/481 |

FOREIGN PATENT DOCUMENTS

| | | | |
|---|---|---|---|
| 2427148 | 2/1980 | France | 72/481 |

*Primary Examiner*—David Jones

*Attorney, Agent, or Firm*—Cushman, Darby & Cushman

[57] ABSTRACT

A connecting system which includes a slack connecting device between a blade and a support and an elastic member for taking up slack between the blade and the support in a direction of application of operating forces. A face of the support which reacts to the bending force component in a direction parallel to a plane of a sheet metal panel and perpendicular to a bending line is defined by a pair of superimposed rods which slide in the direction of the bending line in their respective seats with differentiated sections.

2 Claims, 3 Drawing Sheets

SYSTEM FOR CONNECTING A BENDING BLADE TO ITS CORRESPONDING SUPPORT IN A SHEET METAL PANEL BENDING MACHINE

The present invention relates to a system for connecting a bending blade to its corresponding support in a sheet metal panel bending machine.

As is known, the blades of bending machines carry out the task of executing the bending of the edges of sheet metal panels held between a fixed counterblade and a movable blank holder.

During the execution of the bending operation the blades are subjected to a deformation whose development and course depend on the length of the bent edge and on the type of constraint between the blades and the corresponding support.

In the known machine, the blades are rigidly constrained to their support, over their entire length, while the part subject to deformation extends only over the length of the sheet metal panel. During the bending operation the blades thus assume a slighly curved shape resulting in a correspondingly curved line of bending.

To overcome this drawback blades have been accomplished equipped with rear stiffeners opposite the middle section of the blade used for bending the sheet metal panel, with the object of increasing the rigidity of said central section of the blade and compensate for its greater deformation with respect to the lateral sections which are not in contact with the sheet metal. This arrangement is effective from the point of view of obtaining a deformation of the blade that is uniform along the entire section that is in contact with the sheet metal but is constrained by the dimensions of the sheet metal panels to be cut. When such dimensions vary, as can be seen, the drawback is repeated and the stiffener must be changed.

In order to adapt the deformation of the blade to the dimensions of the sheet metal panels it has been hypothesized to slacken the blade on its support in the parts which are not used for bending so that said parts can be loosened, in the sense that they are not only rigidly constrained on the support, but they can be free to allow the deformation of that part of the balde which is rigidly connected to the support.

Said slackening must, however, be adjusted whenever the length of the bend is changed. Such an adjustment is fairly complicated and takes a considerable amount of time, considering the fact that the bolts for fastening the blades are not easily accessible.

In view of this state of the art, the object of the present invention is to accomplish a system for connecting a bending blade to its corresponding support in a sheet metal panel bending machine, whereby it is possible to execute simply and rapidly, in a mechanical and automatic manner, the adjustment of the extension of those parts of the blade to be slackened with respect to the support.

According to the invention, such object is attained with a connecting system characterized in that it includes slack connecting means between the blade and it support, elastic means for taking up the slack between said blade and said support in the direction of the application of the operating forces and means for defining a face of the support with a variable length which reacts rigidly against the component of the bending force in a direction parallel to the plane of a sheet metal panel and perpendicular to the bending line, said means including a pair of superimposed rods sliding in reciprocally inverse directions in the direction of the bending line in corresponding seats with differentiated sections obtained in said support, each seat being formed by at least two consecutive segments of different depths which determine different degrees of reaction of the corresponding rod to the bending force applied to the corresponding parts of the blade, the shallower segments of the two seats being symmetrically opposite with respect to the median vertical axis of the blade support and being one above the other in the central part of the support, and there being also means for the reciprocal movement of said rods in order to vary in a corresponding manner the extension of their parts coinciding with the shallower segments of their seats and consequently the extension of the central part of the support which reacts rigidly to said component of the bending force.

With this arrangement the two sliding rods can occupy a large number of positions starting from that in which they are one above the other in the central part of the support defined by short superimposed sections of the shallower segments, up to that in which said rods occupy the entire length of their corresponding seats.

In the first position a small central part of the two superimposed rods is up against the shallower segments of their seats, thus producing a force of reaction or "stiffening" of the bending blade that is stronger in the central section of the blade than at its ends, where the rods, since they are opposite the deeper segments of their seats, are free to deform and thus allow the corresponding deformation of the blade's sections. It follows that the deformation of the blade, forced by the sheet metal panel in the stiffened part and only induced as a consequence in the outer slack parts, is practically constant from one end of the blade to the other and the balde can thus execute a bend that is along an exact straight line.

As the rods are made to slide one towards the other the extent of the rods' superimposition is increased, so that these stop against sections of increasing length of the shallower segment of the corresponding seats; it follows that the length of the reactive part of the support increases and thus the length of the stiffened section of the blade also increases while at the same time the length of the slack outer sections of the bending blade decreases.

The length of the stiffened section of the blade is obviously adjusted in relation to the width of the edge of the sheet metal panel to be bent.

One possible embodiment of the present invention is illustrated as a non-limiting example in the enclosed drawings, in which.

The enclosed drawings illustrate a support 1 which can hold a bending blade 2 in a bending machine for sheet metal panels.

Figure 1:
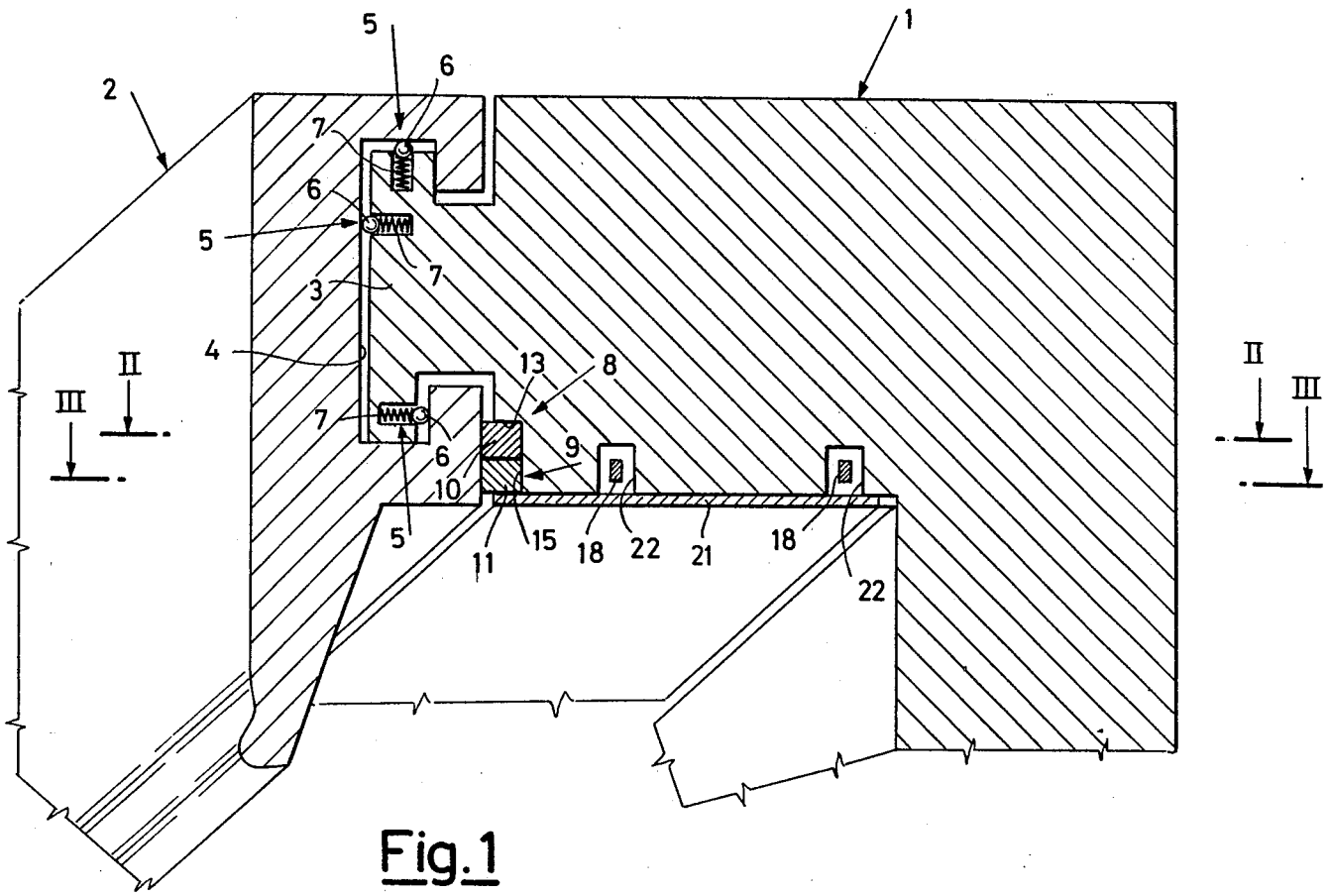
FIG. 1 shows a blade-support assembly equipped with a connecting system according to the invention in a perspective view sectional along the lines I—I of FIGS. 2 and 3.

As shown in FIG. 1, the support 1 is equipped with a T-shaped guide 3 or which the blade 2 is inserted, whose rear side is equipped with a complementary T-shaped groove 4 with an enlarged section, so that a little slack exists between the blade and the support. Elastic means 5 for taking up the slack between the blade 2 and the support 1 in the direction of the application of the operating forces are distributed along the T-shaped guide 3. Said elastic means are spheres 6 assisted by springs 7.

Figure 2:
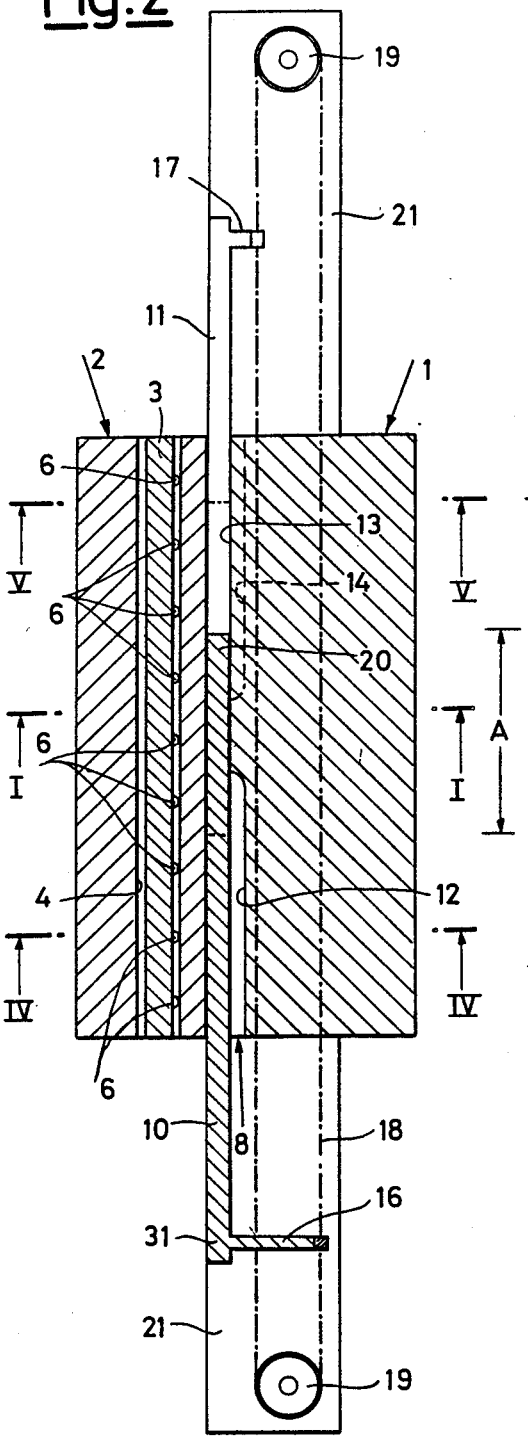
FIG. 2 shows said assembly sectioned on a plan along the line II—II in FIG. 1.
Figure 3:
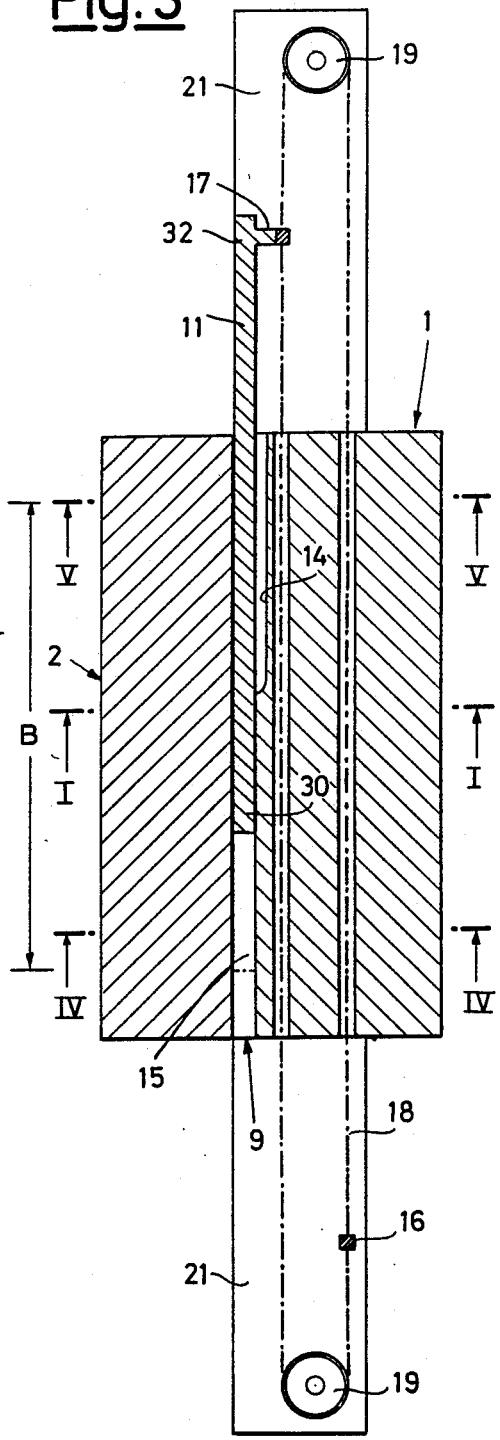
FIG. 3 shows said assembly sectioned on a plan along the line III—III in FIG. 1.
Figure 4:
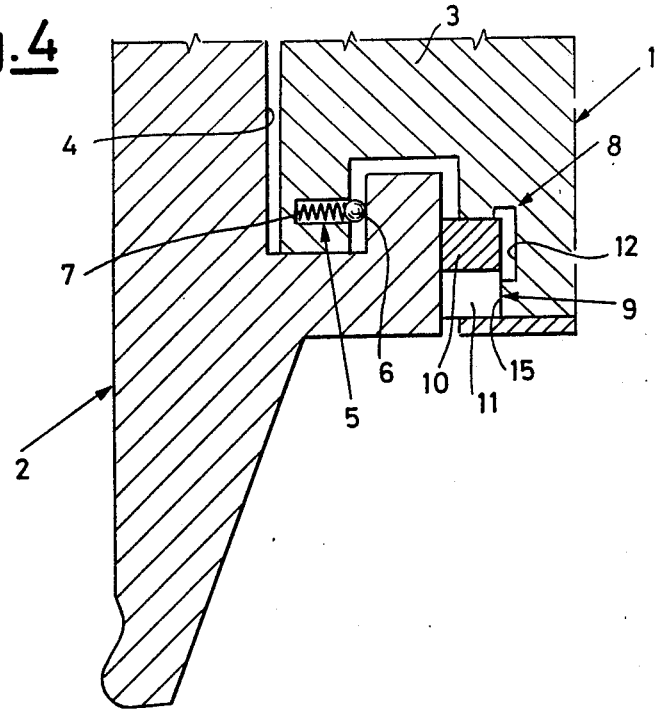
FIG. 4 shows an enlarged detail of said assembly sectioned along the line IV—IV in FIGS. 2 and 3.
Figure 5:
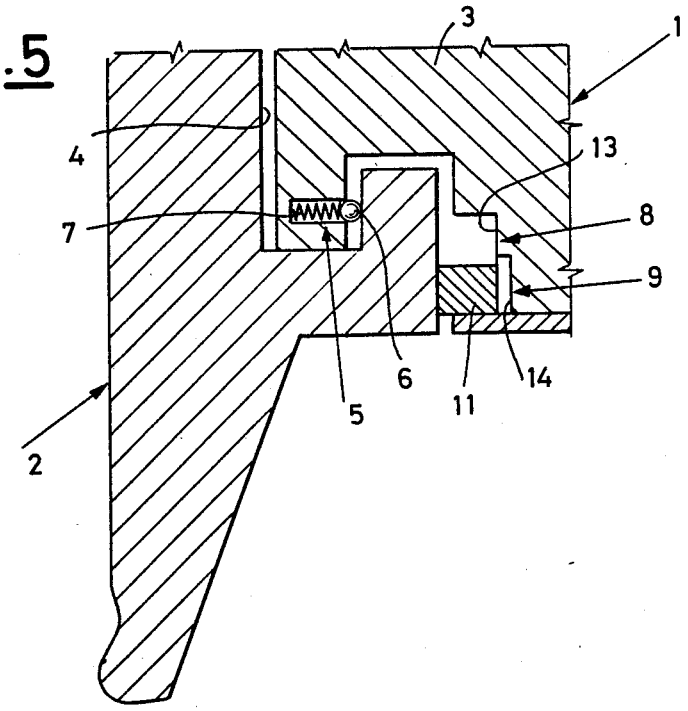
FIG. 5 shows the same detail sectioned along the line V—V in FIGS. 2 and 3.

Along the contact wall between the support 1 and the blade 2 there is an upper seat 8 and a lower seat 9, one above the other, in which the corresponding rods 10 and 11 slide (FIGS. 2 and 3).

The upper seat 8 consists of a first deeper segment 12 followed by a second shallower segment 13, in the same way that the lower seat 9 consists of a first deeper segment 14 followed by a second shallower segment 14. As can be seen in FIGS. 2 and 3, the shallower segments 13 and 15 are in a symmetrical and opposite position and are one above the other for a certain section of the central part of the support while the deeper segments 12 and 14 are one above the other over a large number of the shallower segments 15 and 13, respectively.

The rods 10 and 11 have first ends, 20 and 30 respectively, which are free to slide within the seats 8 and 9 and second ends 31 and 32 connected by means of their respective arms 16 and 17 to opposite branches of a chain 18 which is closed in the shape of a ring and is operated by a pair of toothed gears 19, one of which is rotated by the chain and the other is connected to a motor (not shown). Such toothed gears 19 are supported by a plate 21 which constitutes the bottom of the lower seat 9 and is positioned to close the passages 22 for the chain 18, which pass through the support 1 along its entire length (FIG. 1).

The system for connecting the blade 2 with the support 1 operates as follows.

Consider that initially the rods 10 and 11 are inserted in their respective seats 8 and 9 and that they are in the position indicated in FIGS. 2 and 3. One part of the upper rod 10 occupies the initial part of the shallower segment 13 and the entire deeper segment 12, while part of the lower rod 11 occupies the initial part of the shallower segment 15 as well as the entire deeper segment 14. As can be seen those parts of rods 10 and 11 which occupy the initial sections of their respective shallower segments 13 and 15 interact on one side with the rear part of the blade and on the other with the support, creating a rigid shoulder for the blade along the entire central section A. The parts of the rod which occupy the deeper segments on the one side react with the part of the blade and on the other face the free part of the deeper segments 12 and 14 so that, as they are not constrainged, they can deform and oscillate within said segments, The blade 2 is thus constrained in a rigid manner with support 1 in its central section (A), which is intended to correspond to the sheet metal panel to be cut, and in a slack manner in its lateral sections beyond the area corresponding to the sheet metal panel.

The bending machine whose blade is arranged as described above thus effectively bends the edges of sheet metal panels whose sides have a length equal to that of segment A.

If a sheet metal panel with a greater width is to be bent it is necessary to increase the length of the support's central part which constitutes a rigid shoulder. This is obtained by sliding the rods 10 and 11 one towards the other up to the limits shown by a dashed and dotted line in FIGS. 2 and 3, so that they occupy a greater section of their respective shallower segments 13 and 15. In this way the support's rigid shoulder extends up to a section B.

If, on the other hand, a sheet metal panel with a smaller width is to bent the rods 10 and 11 are made to slide away from one another, decreasing as required the length of the stiffened section.

The sliding motion of the rods 10 and 11 are obtained by means of the chain 18, to which the rods are connected by means of the corresponding arms 16 and 17. The chain is made to rotate by a motor connected, as already said, to one of the toothed gears 19 supporting the chain.

In a different and more versatile version of the invention the two rods 10 and 11 are controlled independently to obtain a uniform bending of the sheet metal panels which may not be positioned along the centre line of the machine; in said version the chain 18 is replaced by two equal superimposed chains operated by different motors.

It is to be noted that the described assembly of the bending blade 2 to the support 1 also has the important effect of allowing the removal of the blade of simply sliding it along the T-shaped guide 3 for the simple and quick replacement of the blade when this is required.

I claim:

1. System for connecting a bending blade to its corresponding support in a bending machine for sheet metal panels, comprising:

slack connecting means between the blade and the support, elastic means for taking up slack between said blade and support in a direction of application of operating forces, and means for defining a face of the support with a variable length which reacts rigidly against a component of bending force in a direction parallel to a plane of a sheet metal panel and perpendicular to a bending line, said means include a pair of superimposed rods sliding in reciprocally inverse directions in the direction of the bending line in corresponding seats with a differentiated section obtained in said support, each seat being formed by at least two consecutive segments of different depths which determine different degrees of reaction of the corresponding rod to the bending force applied to the corresponding parts of the blade, shallower segments of the two seats being symmetrically opposite with respect to a median vertical axis of said support and being superimposed one over the other in a central part of the support, and there being also means for reciprocal movement of said rods in order to to vary in a corresponding manner an extension of their parts coinciding with the shallower segments of their seats and consequently an extension of the central part of the support which reacts rigidly to said component of the bending force.

2. Connecting system according to claim 1, characterized in that one end of each of the rods has an arm engaging said means for reciprocal movement.

* * * * *